US010418212B2

(12) United States Patent
Warenits et al.

(10) Patent No.: US 10,418,212 B2
(45) Date of Patent: Sep. 17, 2019

(54) PYROTECHNIC ISOLATOR

(71) Applicant: HIRTENBERGER AUTOMOTIVE SAFETY GmbH, Hirtenberg (AT)

(72) Inventors: Peter Warenits, Woellersdorf (AT); Leyton Munoz, Brunn am Gebirge (AT)

(73) Assignee: HIRTENBERGER AUTOMOTIVE SAFETY GMBH, Hirtenberg (AT)

( * ) Notice: Subject to any disclaimer, the term of this patent is extended or adjusted under 35 U.S.C. 154(b) by 0 days.

(21) Appl. No.: 15/764,352

(22) PCT Filed: Oct. 19, 2016

(86) PCT No.: PCT/AT2016/060085
§ 371 (c)(1),
(2) Date: Mar. 29, 2018

(87) PCT Pub. No.: WO2017/066816
PCT Pub. Date: Apr. 27, 2017

(65) Prior Publication Data

US 2019/0051478 A1 Feb. 14, 2019

(30) Foreign Application Priority Data

Oct. 19, 2015 (AT) ..... A 50889/2015

(51) Int. Cl.
*H01H 9/30* (2006.01)
*H01H 39/00* (2006.01)
*H01H 9/32* (2006.01)

(52) U.S. Cl.
CPC ..... *H01H 39/006* (2013.01); *H01H 9/30* (2013.01); *H01H 9/32* (2013.01); *H01H 2039/008* (2013.01)

(58) Field of Classification Search
CPC ..... G02B 21/0032; G02B 21/361; G02B 21/0076; G02B 21/0044; G06T 3/4038
See application file for complete search history.

(56) References Cited

U.S. PATENT DOCUMENTS 4,692,733 A * 9/1987 Oakes ..... H01H 85/047 218/1
6,078,108 A 6/2000 Froschl
(Continued)

FOREIGN PATENT DOCUMENTS

DE 19911128 B 12/2000
DE 10209625 A 10/2003
(Continued)

*Primary Examiner* — Truc T Nguyen
(74) *Attorney, Agent, or Firm* — Andrew Wilford

(57) ABSTRACT

The pyrotechnic isolating apparatus (1) for isolating a conductor (8) using an isolating punch (14) has a housing, in which the isolating punch (14) is routed, and an ignition unit (6) for driving the isolating punch (14). According to the invention, a quenching means (13) for suppressing or quenching an arc is arranged between the isolating punch (14) and the ignition unit (6). Therefore, the quenching means (13) also transmits the drive force to the isolating punch (14). The isolating punch (14) can have at least one cutting edge, so that a printed circuit board (18) is stamped out of the conductor (8) and the conductor ends (8*a*, 8*b*) are at a large distance. The isolating punch (14) is preferably composed of electrically conductive material with a melting point of greater than 2000° C. It is advantageous when a thrust piston (12) is provided between the ignition unit (6) and the quenching means (13) in order to shield the hot combustion gases from the quenching means (13). In order to brake the isolating punch (14), a damping element (16) can be provided on the opposite side of the conductor (8). When the isolating punch is at a lateral distance from the housing at least in regions there, the quenching means (13)
(Continued)

can continue to flow even after the isolating punch (14) is braked.

20 Claims, 1 Drawing Sheet

(56) References Cited

U.S. PATENT DOCUMENTS

| | | | | |
|---|---|---|---|---|
| 6,144,111 | A | 11/2000 | Krappel | |
| 7,239,225 | B2 | 7/2007 | Tirmizi | |
| 7,498,531 | B2 | 3/2009 | Knauss | |
| 7,511,600 | B2 | 3/2009 | VonBehr | |
| 8,653,386 | B2 | 2/2014 | Ukon | |
| 8,957,335 | B2 | 2/2015 | Sprenger | |
| 9,425,010 | B2 | 8/2016 | Hentschel | |
| 2004/0041682 | A1* | 3/2004 | Pasha | H01H 39/006 337/401 |
| 2005/0083164 | A1* | 4/2005 | Caruso | H01H 39/006 337/157 |
| 2005/0083165 | A1* | 4/2005 | Tirmizi | H01H 39/006 337/157 |
| 2010/0328014 | A1* | 12/2010 | Suzuki | H01H 9/12 337/30 |
| 2011/0057762 | A1* | 3/2011 | Burger | H01H 33/666 337/401 |
| 2013/0220095 | A1 | 8/2013 | Ukon | |
| 2016/0211087 | A1* | 7/2016 | Minke | H01H 1/20 |
| 2016/0343524 | A1* | 11/2016 | Gaudinat | H01H 39/006 |

FOREIGN PATENT DOCUMENTS

| | | | |
|---|---|---|---|
| DE | 10209626 | A | 10/2003 |
| DE | 102007033180 | A | 2/2009 |
| DE | 202007151504 | A | 4/2009 |
| DE | 102010015240 | A | 11/2011 |
| JP | 2014049272 | B | 3/2014 |
| WO | 2015117878 | A | 8/2015 |

* cited by examiner

PYROTECHNIC ISOLATOR

CROSS REFERENCE TO RELATED APPLICATIONS

This application is the US-national stage of PCT application PCT/AT2016/060085 filed 19 Oct. 2016 and claiming the priority of Austrian patent application A50889/2015 itself filed 19 Oct. 2015.

FIELD

The present invention relates to a pyrotechnic circuit breaker for disconnecting a conductor by means of an isolating punch, with the circuit breaker having a housing in which the isolating punch is movable and an ignition unit for driving the isolating punch.

PRIOR ART

In automobile safety, battery disconnection systems have the task of switching off certain circuits in a collision in order to minimize the risk of fire. Components that are not necessary for emergency operation are disconnected from the power supply in order to reduce the risk of a fire in the event of a short circuit.

The first electrically operable battery disconnection systems consisted of available electromechanical components, as described, for the sake of example, in DE 29613221 [U.S. Pat. No. 6,073,108] of Gebauer and Griller. Moreover, it has been suggested to use relays and generic constructions of that type for the task of switching off power, as described for example in DE 19911128 of Tyco Electronics.

These electromechanical systems have the drawback that they require to operate a high level of energy that must be made available by power semiconductors and cabling having the appropriate cross section. The effect of mechanical shocks as a result of drive operation can cause tiny interruptions in the power supply that can lead to malfunctions or damage in sensitive devices. The latter also applies to the group of the circuit breakers in which, during normal operation, the conductors are connected by a force fit and are spread pyrotechnically as needed, as described for example in U.S. Pat. No. 6,144,111 of BMW. As a result of vibrations and thermal expansion during heating, a slow deterioration of the connection occurs over the service life until the above-mentioned effects arise here as well.

The next step involved devices having a continuous conductor that is disconnected as needed. In DE 10209626 and DE-10209625 of MBB, a conductor is described that has an axially positioned explosive charge on its interior that destroys the conductor as necessary. The main problem with this type of construction is that the igniter and ignition line are constantly being heated by the flow of current in the conductor and age. Due to their construction, this type has only a slight ability to conduct current. In order to avoid this drawback, it has been proposed to position the igniter next to the line and to disconnect the line by a cutting punch, as described in patent applications of Dynamit Nobel DE 102004008120 [U.S. Pat. No. 7,511,600] and DE 102004010071 [U.S. Pat. No. 7,498,531]. DE-2004008120 describes an isolator in which a continuous conductor rail is oriented 90° to the point of disconnection, and DE 102004010071 describes the cutting die as a discrete inserted bar, with the principle of DE 102004008120 also being illustrated in the figures. Switches having this construction are limited in their disconnecting capacity both in terms of the voltage and the amperage (at about 1 kA).

The increasing energy consumption of electrical systems that is accommodated with the 48 V vehicle electrical system, and the beginning penetration of the market by electrically powered vehicles are creating a need for disconnecting devices for higher voltages. These require technical solutions for the extinction or suppression of the resulting electric arc, the occurrence of which is pronounced starting at about 30 V with direct voltage.

In DE 102010015240 a circuit breaker is described in which the flow of current is through a sleeve and a bolt inserted therein. Upon ignition, the bolt is driven out of the sleeve, thereby disconnecting the electrical connection. Moreover, with ignition by bursting a capsule filled with inert gas, the system enables inert gas to flow to the resulting electric arc. It must be questioned whether the inert gas behaves inertly under the conditions in an electric arc and has the desired effect.

U.S. Pat. No. 7,239,225 describes a circuit breaker in which a nonconductive mass is brought into position after the disconnection of the conductor at the predetermined breaking points. In one embodiment, the insulating body is injected along with the housing that is preferably made of a high-strength thermoplastic that is stable at high temperatures. The problem of the electric arc is not addressed. A thermoplastic would also have little durability in the presence of a possible electric arc.

The category-defining patent FR 3017239 [WO 2015117878] also interrupts the electrical circuit by means of a nonconductive punch and extinguishes the electric arc by dividing it into a plurality of individual electric arcs according to the principle of the deionizing chamber. Likewise, DE 102007033180 adheres to the principle of the deionizing chamber as well, with at least two interrupter plates being provided along the direction of disconnection. If one assumes that the burning voltage of an electric arc is at 50 V, at least five plates are required for hybrid drives in the medium-voltage range (300 V). The construction is elaborate and therefore cost- and space-intensive.

DE 102010035684 [U.S. Pat. No. 8,957,335] describes a system in which a fluent medium that is moved by an auxiliary drive opens a disconnect and surrounds it at least temporarily at the moment of disconnection. The fluent medium has an isolating and arc-quenching effect. It is disadvantageous that this construction only works with conductors that have been substantially pre-weakened, as described for example in DE 102010011150 [U.S. Pat. No. 9,425,010], to be disconnected.

DESCRIPTION OF THE INVENTION

The current state of the art does not satisfactorily meet the challenge of reliably disconnecting intense currents at high voltages while simultaneously keeping system costs economical.

It is the object of the present invention to provide an economical circuit breaker that enables the disconnection of a circuit breaker with currents of up to 8 kA and voltages of up to 500 V and beyond.

According to the invention, this object is achieved by a circuit breaker of the type mentioned above in that an extinguishing medium for suppressing or extinguishing the electric arc occurring during disconnection is provided between the isolating punch and the ignition unit so that it is pressurized upon ignition and drives the isolating punch.

By virtue of the isolating punch, a high force for disconnecting the conductor is thus made available as usual so that the conductor need only be weakened moderately. Nevertheless, after the isolating punch has passed through the conductor, the extinguishing medium comes into contact with the remaining portions so that any electric arc is extinguished. Surprisingly, the extinguishing medium is capable of moving the isolating punch without being impaired.

Advantageously, the isolating punch has at least one cutting edge so that a plug is punched out of the conductor upon ignition of the ignition unit. As a result, the portions are automatically separated from one another by a relatively large distance—an advantage that cannot be achieved with the embodiment according to DE 102010035684.

If the isolating punch is rotationally symmetrical, then a circumferential cutting edge will be selected that severs the conductor in two places. If the cutting punch is not rotationally symmetrical, i.e. is rotationally fixed, two spaced cutting edges will need to be provided.

It is advantageous if the isolating punch is made of electrically conductive material. As a result, the current is still able to flow unimpeded while the isolating punch severs the conductor; an electric arc can occur only after the isolating punch has passed through the conductor, and by then the extinguishing medium has already hit the portions, which prevents the formation of the electric arc or extinguishes an electric arc that has already formed.

Moreover, it is advantageous if the isolating punch is made of a material having a melting point of over 2000° C. In this way, it is not damaged by any electric arc that might occur briefly, if at all, and can move on unimpeded from the conductor after having severed same.

Preferably, the isolating punch is at least 1 mm from the conductor in the starting position. Even though 1 mm may appear to be a very short distance, the isolating punch accelerates in a very pronounced manner over this distance when the ignition unit ignites so that it strikes the conductor at substantial speed, which augments its severing power accordingly.

According to another embodiment of the invention, a plunger is provided between the ignition unit and the extinguishing medium. The extinguishing medium is thus protected from the hot combustion gases that occur during ignition of the ignition unit; it must therefore only withstand the resulting pressure. The pyrotechnic pressure is thus transferred via the plunger to the extinguishing medium.

To facilitate the disconnection, it is advantageous if the conductor has at least one groove.

According to another preferred feature of the invention, a damping element is provided on the side of the conductor facing away from the isolating punch so that the isolating punch is slowed after severing the conductor, preferably with a braking deceleration of at least 10000 $m/s^2$. This prevents elastic rebounding of the isolating punch; if an elastic rebound were to occur, the isolating punch, which is preferably electrically conductive, might come into contact with the portions again and thus undo the interruption of the circuit.

It is advantageous if, on the side of the conductor facing away from the ignition unit, the isolating punch is spaced from the housing laterally at least in some regions so that the extinguishing medium flows past the isolating punch after severing the conductor.

The isolating medium can thus also continue moving when the isolating punch has already been stopped; this movement of the isolating medium has the effect that fresh, cool isolating medium always reaches the electric arc that is favorable for extinguishing it.

Preferably, the portions of the conductor are mobile in the longitudinal direction after the disconnection. Since the extinguishing medium fills the space between the portions after the severing of the conductor, a flow of the extinguishing medium in the direction of disconnection also takes place so that the extinguishing medium exerts a pressure on the two portions and thus drives them apart so that their spacing from each other is automatically increased as a result of the mobility of the portions.

The extinguishing medium can be a (viscous) liquid at room temperature, but it can also be a gel or a paste. The extinguishing medium is preferably silicone or a silicone compound.

BRIEF DESCRIPTION OF THE DRAWINGS

The invention will be explained in further detail on the basis of the attached drawings.

PREFERRED MODE OF CARRYING OUT THE INVENTION

Figure 1:
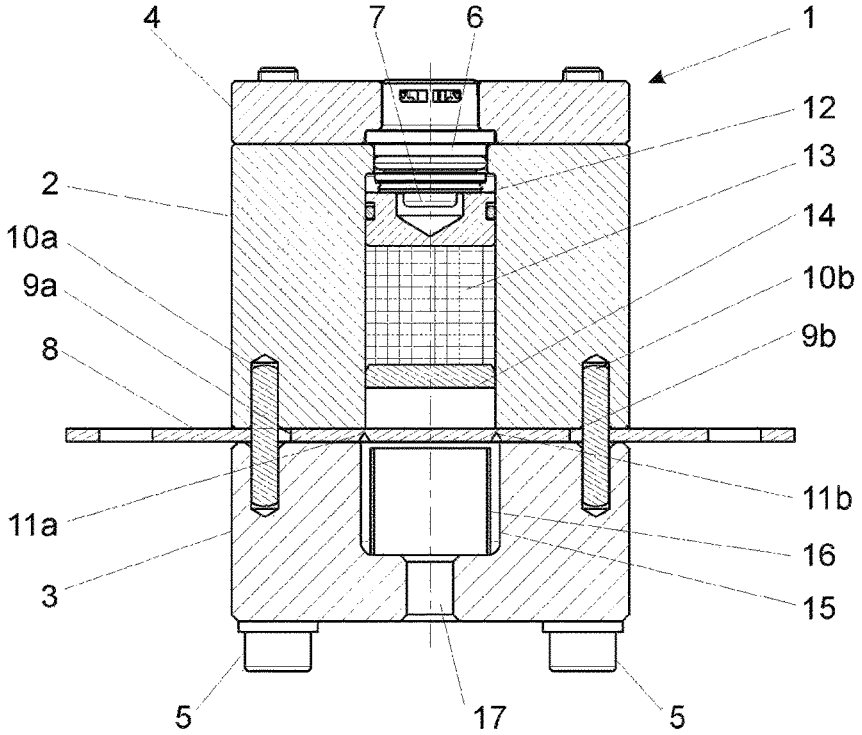
FIG. 1 shows an embodiment of a circuit breaker according to the invention in the non-tripped state.

A housing 1 of the circuit breaker consists of an upper part 2, a lower part 3, and a cover plate 4. These housing parts are held together by screws 5.

An ignition unit 6 with electrical igniter 7 is provided in the upper part 2. A conductor 8 has two portions 8*a* and 8*b* clamped between the upper part 2 and the lower part 3. The portions 8*a*, 8*b* have respective slots 9*a*, 9*b* and are secured by respective pins 10*a*, 10*b*. Grooves 11*a* and 11*b* that facilitate disconnection are provided on the lower face of the conductor.

A plunger 12 behind an extinguishing medium 13 and an isolating punch 14 is provided adjacent the igniter 7 in the upper part 2.

A chamber 15 holding a damping element 16 is provided in the lower part 3 and has a vent hole 17.

The housing parts are made of an electrically insulating, impact-resistant material such for example as polyamide. A silicone paste is recommended as an extinguishing medium 13, but oil or sand or the like can also be used as an extinguishing medium 13.

Successful tests were conducted with a GTMS igniter with 75 mg ZPP (zirconium/potassium perchlorate) and 45 mg $BKNO^3$ (boron/potassium nitrate) and an isolating punch 14 made of free-cutting steel. The plunger 12 is made of machining steel or an impact-resistant, glass fiber-reinforced polyamide. The conductor 8 is made of copper with a cross section of 16×2 mm, with the cross section being reduced to 16×1 mm at the predetermined breaking points.

Figure 2:
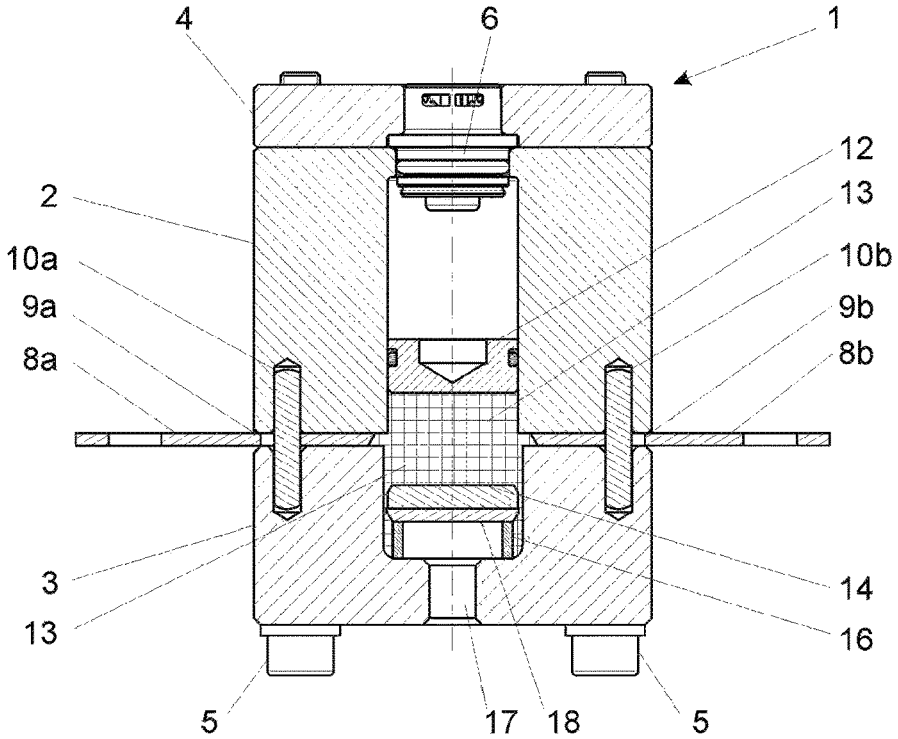
FIG. 2 shows this embodiment when tripped.

After triggering (see FIG. 2), the isolating punch 14 cuts a plug 18 out of the conductor 8 and compresses the damping element 16 so far that now only extinguishing medium 13 is between the portions 8*a*, 8*b*. The portions 8*a*, 8*b* have moved outward according to their mobility in the slots 9*a*, 9*b*.

Upon ignition of the igniter 7 in the ignition unit 6, pressure is exerted on the plunger 12 to moves the isolating punch 14 against the conductor 8 via the extinguishing medium 13. The isolating punch 14 punches the plug 18 out of the conductor 8 at the Grooves 11*a*, 11*b* and presses them into the chamber 15.

After the isolating punch 14 has passed the plane of the conductor 8, the punched-out plug 18 strikes the damping element 16 and is slowed together with the isolating punch 14.

This results in an increase in pressure in the extinguishing medium 13, which displaces the portions 8*a*, 8*b* in the slots 9*a*, 9*b* according to their mobility and, due to a larger bore diameter of the chamber 15, is also able to flow past the isolating punch 14 into the chamber 15. This ensures a longer-lasting flow of the extinguishing medium 13, which has a cooling effect while also delaying and/or lengthening the electric arc.

This effect can be additionally supported by using a the isolating punch 14 made of an electrically conductive material so it can act as a bridge for the current after the mechanical disconnection, and thus postpone the formation of an electrical arc until the extinguishing medium 13 arrives at the points of disconnection.

In a development of this idea, the isolating punch 14 can be made of a very temperature-resistant metal such as wolfram, for example.

Movement of the two portions 8*a*, 8*b* also serves to extinguish any electric arc that may be present, because the length of the electric arc is increased and the space is filled with extinguishing medium 13.

The early extinguishment of the electric arc is important because it becomes ever more difficult to extinguish as the burning time increases and introduces very large quantities of energy into the housing to proportional disadvantageous effect.

Another point is therefore that the speed of the isolating punch 14 is at least 10 m/s in order to ensure an appropriately fast severing of the conductor 8 and fast movement of the extinguishing medium 13. The entire disconnecting process can thus take place in less than 3 ms.

If the force of the igniter 7 is insufficient for the speed that is required, additional propellant can be provided between the plunger 12 and the igniter 7.

The vent hole 17 allows air to escape from the chamber 15 when filled with the extinguishing medium 13. This prevents the punched-out plug 18 and the isolating punch 14 from being pushed back toward their original position after disconnection has occurred, which might result in a restored contact.

The invention claimed is:

1. A pyrotechnic circuit breaker for disconnecting a conductor, the circuit breaker comprising:

an isolating punch;

a housing in which the isolating punch is movable;

an igniter for moving the isolating punch;

an extinguishing medium for suppressing or extinguishing an electric arc occurring during disconnection and between the isolating punch and the igniter so that it is pressurized upon ignition and drives the isolating punch; and a plunger between the igniter and the extinguishing medium.

2. The circuit breaker defined in claim 1, wherein the isolating punch has at least one cutting edge so that a plug is punched out of the conductor upon ignition of the igniter.

3. The circuit breaker defined in claim 1, wherein the isolating punch is made of electrically conductive material.

4. The circuit breaker defined in claim 1, wherein the isolating punch is made of a material with a melting point of greater than 2000° C.

5. The circuit breaker defined in claim 1, wherein the isolating punch is spaced from the conductor by at least 1 mm in a starting position.

6. The circuit breaker defined in claim 1, wherein the conductor has at least one groove in order to facilitate the disconnection.

7. The circuit breaker defined in claim 1, wherein, on the side of the conductor facing away from the igniter, the isolating punch is spaced from the housing laterally at least in some regions so that the extinguishing medium flows past the isolating punch after severing of the conductor.

8. The circuit breaker defined in claim 1, wherein portions of the conductor are mobile in the longitudinal direction after the disconnection.

9. The circuit breaker defined in claim 1, wherein the extinguishing medium is a liquid at room temperature.

10. The circuit breaker defined in claim 1, wherein the extinguishing medium is a gel.

11. The circuit breaker defined in claim 1, wherein the extinguishing medium is a paste.

12. The circuit breaker defined in claim 1, wherein the extinguishing medium is silicone or a silicone compound.

13. A pyrotechnic circuit breaker for disconnecting a conductor the circuit breaker comprising an isolating punch;

a housing in which the isolating punch is movable;

an igniter for moving the isolating punch;

an extinguishing medium for suppressing or extinguishing an electric arc occurring during disconnection and between the isolating punch and the igniter so that it is pressurized upon ignition and drives the isolating punch; and a damping element on a side of the conductor facing away from the isolating punch so that the isolating punch is slowed after severing the conductor.

14. The circuit breaker defined in claim 13, further comprising:

a plunger between the igniter and the extinguishing medium.

15. The circuit breaker defined in claim 13, wherein the isolating punch has at least one cutting edge so that a plug is punched out of the conductor upon ignition of the igniter.

16. The circuit breaker defined in claim 13, wherein the isolating punch is made of electrically conductive material.

17. The circuit breaker defined in claim 13, wherein the isolating punch is made of a material with a melting point of greater than 2000° C.

18. The circuit breaker defined in claim 13, wherein the isolating punch is spaced from the conductor by at least 1 mm in a starting position.

19. The circuit breaker defined in claim 13, wherein, on the side of the conductor facing away from the igniter, the isolating punch is spaced from the housing laterally at least in some regions so that the extinguishing medium flows past the isolating punch after severing of the conductor.

20. The circuit breaker defined in claim 13, wherein portions of the conductor are mobile in the longitudinal direction after the disconnection.

* * * * *